US006874935B2

(12) United States Patent
Edelman et al.

(10) Patent No.: US 6,874,935 B2
(45) Date of Patent: Apr. 5, 2005

(54) DOUBLE GUSSETED TAMPER EVIDENT SLIDER BAG

(75) Inventors: Paul F. Edelman, Greenwood, IN (US); David W. Keith, Shelbyville, IN (US)

(73) Assignee: Pliant Corporation, Schaumberg, IL (US)

( * ) Notice: Subject to any disclaimer, the term of this patent is extended or adjusted under 35 U.S.C. 154(b) by 0 days.

(21) Appl. No.: 10/402,492

(22) Filed: Mar. 28, 2003

(65) Prior Publication Data

US 2003/0185466 A1 Oct. 2, 2003

Related U.S. Application Data

(60) Provisional application No. 60/368,243, filed on Mar. 28, 2002.

(51) Int. Cl.[7] ..... B65D 33/34

(52) U.S. Cl. ..... 383/5; 383/61.2; 383/64; 383/120; 383/203; 383/210

(58) Field of Search ..... 383/5, 120, 61.2, 383/63, 64, 203, 210, 66

(56) References Cited

U.S. PATENT DOCUMENTS

| | | | | |
|---|---|---|---|---|
| 3,367,380 A | * | 2/1968 | Dickey | 383/104 |
| 4,262,581 A | | 4/1981 | Ferrell | |
| 4,877,336 A | * | 10/1989 | Peppiatt | 383/8 |
| 4,925,316 A | * | 5/1990 | Van Erden et al. | 383/210.1 |
| 5,221,143 A | * | 6/1993 | Peppiatt | 383/29 |
| 5,417,040 A | | 5/1995 | Davoren | |
| 5,529,394 A | | 6/1996 | Davoren | |
| 5,682,730 A | | 11/1997 | Dobreski | |
| 5,692,837 A | | 12/1997 | Beer | |
| 5,713,669 A | | 2/1998 | Thomas et al. | |
| 5,716,138 A | | 2/1998 | Southwell | |
| 5,785,428 A | | 7/1998 | Mazzocchi | |
| 5,788,378 A | | 8/1998 | Thomas | |
| 5,908,245 A | | 6/1999 | Bost et al. | |
| 5,911,508 A | | 6/1999 | Dobreski et al. | |
| 5,938,337 A | | 8/1999 | Provan et al. | |
| 5,964,532 A | | 10/1999 | St. Phillips et al. | |
| 6,148,588 A | | 11/2000 | Thomas et al. | |
| 6,164,826 A | | 12/2000 | Petkovsek | |
| 6,176,394 B1 | | 1/2001 | Shimko et al. | |
| 6,186,663 B1 | | 2/2001 | Ausnit | |
| 6,213,641 B1 | * | 4/2001 | Price | 383/63 |
| 6,257,763 B1 | | 7/2001 | Stolmeier et al. | |
| 6,264,366 B1 | | 7/2001 | Custer | |
| 6,279,298 B1 | | 8/2001 | Thomas et al. | |
| 6,290,393 B1 | | 9/2001 | Tomic | |
| 6,360,513 B1 | | 3/2002 | Strand et al. | |
| 6,361,209 B1 | | 3/2002 | LaRue et al. | |
| 6,378,177 B1 | * | 4/2002 | Athans et al. | 24/585.12 |
| 6,416,221 B2 | * | 7/2002 | Price | 383/63 |
| 6,481,183 B1 | * | 11/2002 | Schmidt | 53/412 |
| 6,536,951 B1 | | 3/2003 | Sill | |

FOREIGN PATENT DOCUMENTS

| | | | | |
|---|---|---|---|---|
| DE | 2752489 | | 5/1979 | |
| EP | 456277 | | 11/1991 | |
| GB | 2254065 | | 9/1992 | |
| WO | WO 01/17864 A2 | * | 3/2001 | 383/61.2 |
| WO | WO02/06130 | | 1/2002 | |

* cited by examiner

*Primary Examiner*—Jes F. Pascua
(74) *Attorney, Agent, or Firm*—Sonnenschein Nath & Rosenthal LLP; Brian R. McGinley

(57) ABSTRACT

A double gusseted, tamper evident, reclosable container 120 of plastic film. The container can be stored in a flat condition but is capable of receiving a bulky item such as a loaf of bread or a stack of paper napkins with the bag assuming a squared off condition. The container 120 has two gussets 185 and 191.

16 Claims, 9 Drawing Sheets

DOUBLE GUSSETED TAMPER EVIDENT SLIDER BAG

BACKGROUND OF THE INVENTION

This application claims priority to U.S. Provisional Patent Application Ser. No. 60/368,243 filed Mar. 28, 2002.

FIELD OF THE INVENTION

The present invention pertains to flexible reclosable containers and in particular to flexible reclosable containers including sliders, tamper evident seals, and a top gusset.

SUMMARY OF THE INVENTION

The present invention relates to flexible reclosable containers, especially those containers incorporating a pair of top gussets.

One embodiment of the invention might involve a plastic film including a pair of side walls which are secured to one another and which define a mouth of the bag. A first gusset and a second gusset are joined to one another and extend across the mouth of the bag. The first gusset includes a tamper evident seal. There are also provided fastener strips mounted on the bag for closing off access to the interior of the bag through the tamper evident seal. The fastener strips allow access when they are disconnected from one another and prevent access when they are connected to one another. The second gusset is adapted to extend across and close off the mouth of the bag when the fastener strips are connected to one another.

In one aspect of the present invention, each container includes a first top gusset and a second top gusset, the first top gusset being expandable to a greater extent than the second top gusset.

In yet another aspect of the present invention, there is a pair of top gussets, one of the top gussets incorporating a pair of opposing fastener strips and a slider for repeatedly closing and opening the fastener strips.

In yet another aspect of the present invention, the container includes a pair of top gussets, with one of the gussets incorporating a tamper evident seal.

In yet other embodiments, the first wall and second wall of one of the gussets are affixed to one another by opposing surfaces forming a peelable seal.

These and other embodiments of the present invention will be apparent from the drawings and description of preferred embodiments that follow.

DESCRIPTION OF THE PREFERRED EMBODIMENTS

Figure 1:
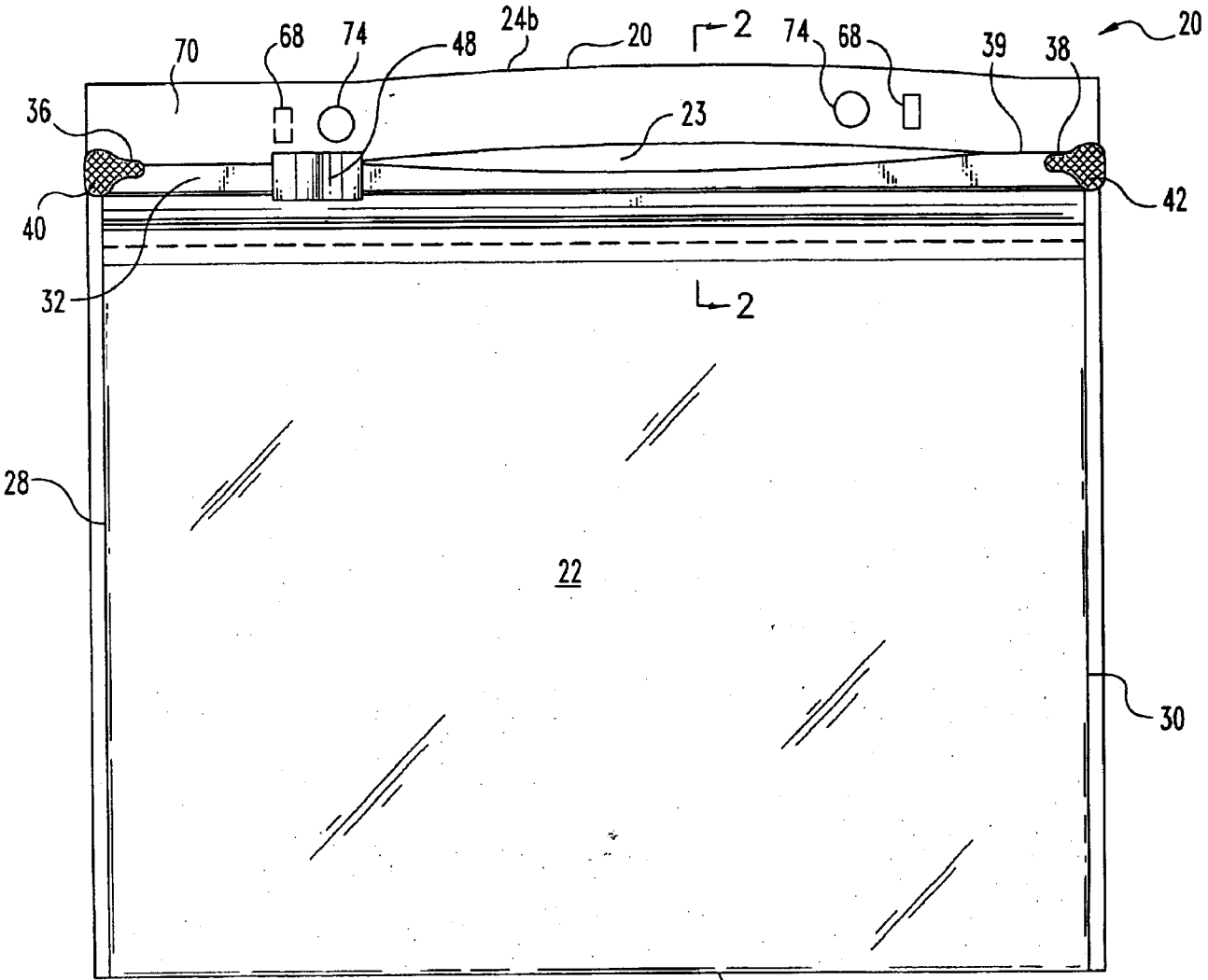
FIG. 1 is a plan side view of a container according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

The present invention relates to improvements in flexible reclosable containers, particularly containers which include a header strip for convenient mounting of the container until it is used, and further including a slider for convenient closing of the container while it is used. The header strip is preferably a single-ply flexible material which extends from the mouth of the container. Preferably, the container or the header strip includes a line of weakness, such as by mechanical perforation or laser scoring, to enable a user to easily separate the container from the header strip. In some embodiments, the header strip includes one or more holes through which the header strip and container assembly can be hung from a stand.

In another embodiment, the header strip extends from the mouth of the bag. Further, the mouth of the bag preferably includes a fastener strip along each of the edges of the mouth, each of the fastener strips including an interlockable profile element. A slider is mounted to the fastener strips for easy interlocking and unlocking of the profile elements.

Preferably, the slider and profile elements are arranged and configured such that the mouth of the bag is substantially open. In this manner, it is most convenient for a user of the bag to place his or her hand between the fastener strips and into the bag, tear the bag off of the header strip, and hold the bag for subsequent filling of the container with a product.

As one example, the bag is particularly useful in situations such as a deli counter in a food store, where the store employee uses one hand to tear off the bag from the header strip, and uses the other hand to place a deli counter product in the container with the other hand. This particular arrangement of the header strip extending from an open mouth, preferably with a slider, reduces the motion and time of the store employee to fill the customer's order.

FIG. 1 shows a flexible reclosable container 20 for containing a product. Container 20 is useful for embodiments in which the container is sold to a consumer in the empty state, although the present invention also contemplates embodiments in which the container includes a product stored therein. Further, some embodiments of the present invention are suitable for use with a form, fill, and seal method of construction, examples of methods for forming, filling, and sealing the flexible reclosable container being found in U.S. Pat. No. 5,956,924, issued Nov. 7, 1997, and incorporated herein by reference.

Container 20 comprises first and second side walls 22 and 24, respectively, which may be made from any suitable thermoplastic film such as, for example, low density polyethylene, linear low density polyethylene, or similar materials. Side walls 22 and 24 include first left transverse side seal 28 and second right transverse side seal 30. Seals 28 and 30 can be formed by any method, including ultrasonic welding and heat fusion methods. Container 20 also includes a bottom edge 26 generally opposite a pair of interlocking fastener strips 32 and 34. Bottom edge 26 may include a fold between side walls 22 and 24, or alternatively edge 26 may include a seal between side walls 22 and 24.

Figure 2:
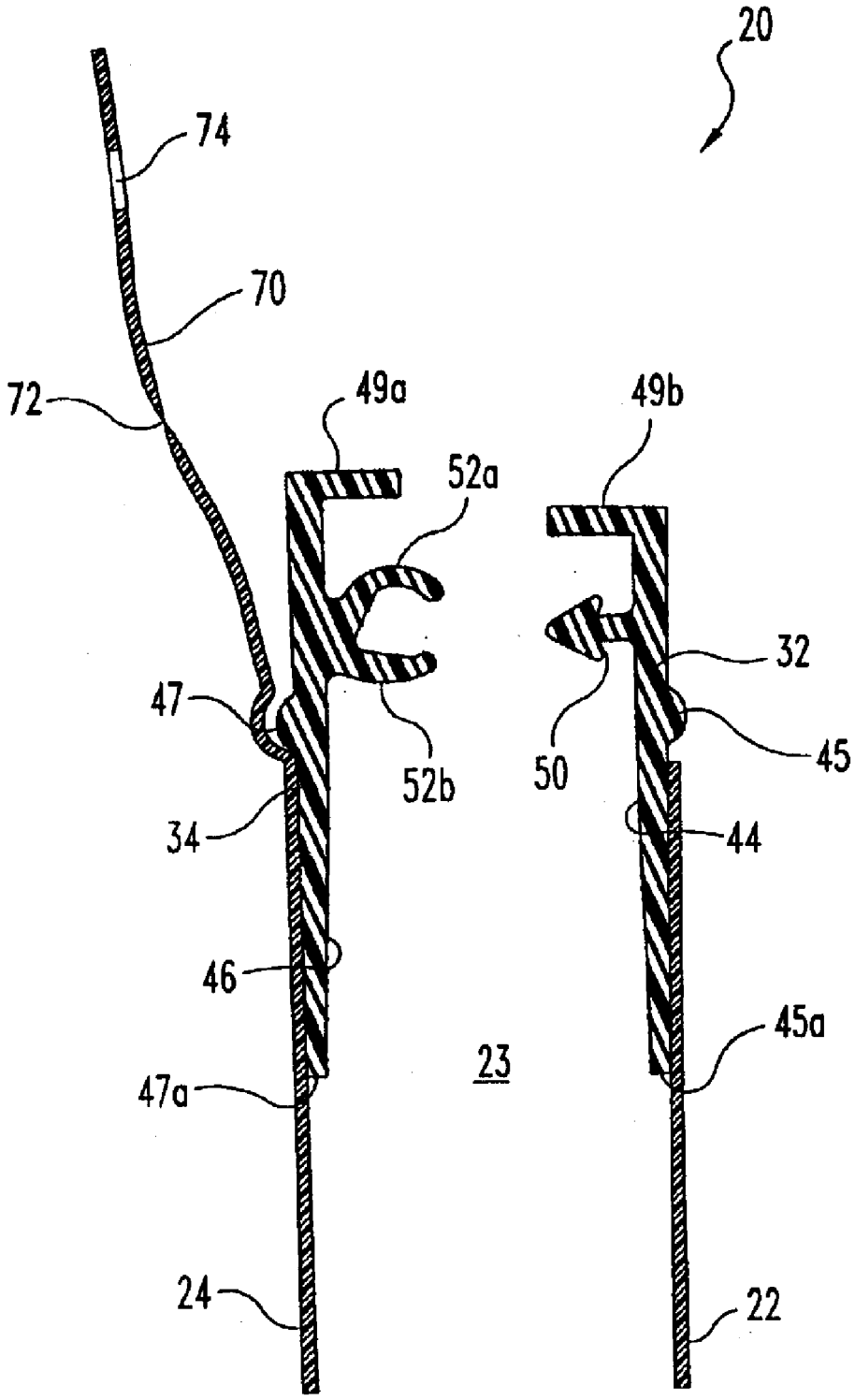
FIG. 2 is a cross-sectional view of the container of FIG. 1 as taken along line 2—2 of FIG. 1.

FIG. 2 is an enlarged cross section of the container of FIG. 1 as taken along line 2—2 of FIG. 1 with side wall 22 spaced apart from side wall 24. As shown in both FIGS. 1 and 2, interlocking fastener strips 32 and 34 including one or more interlockable profiles 50, and 52*a* and 52*b*, respectively, run along the top edge or mouth of container 20. Preferably, fastener strips 32 and 34 are fabricated by an extrusion method, although the present invention contemplates any method of fabrication. Fastener strips 32 and 34 can be attached to side walls 22 and 24 in any manner, including ultrasonic welding, fusion by heat, or adhesive methods. Strips 32 and 34 are sealed together at endstops 36 and 38. Strips 32 and 34 are sealed to each other and also to side walls 22 and 24 at corner seals 40 and 42. Corner seals 40 and 42 are located along their respective edges of container 20. Seals 40 and 42 are generally located below shoulders 45 and 47 of fastener strips 32 and 34, respectively, and above lower edges 45*a* and 47*a* of inner flanges 44 and 46 of fastener strips 32 and 34, respectively.

Figure 3:
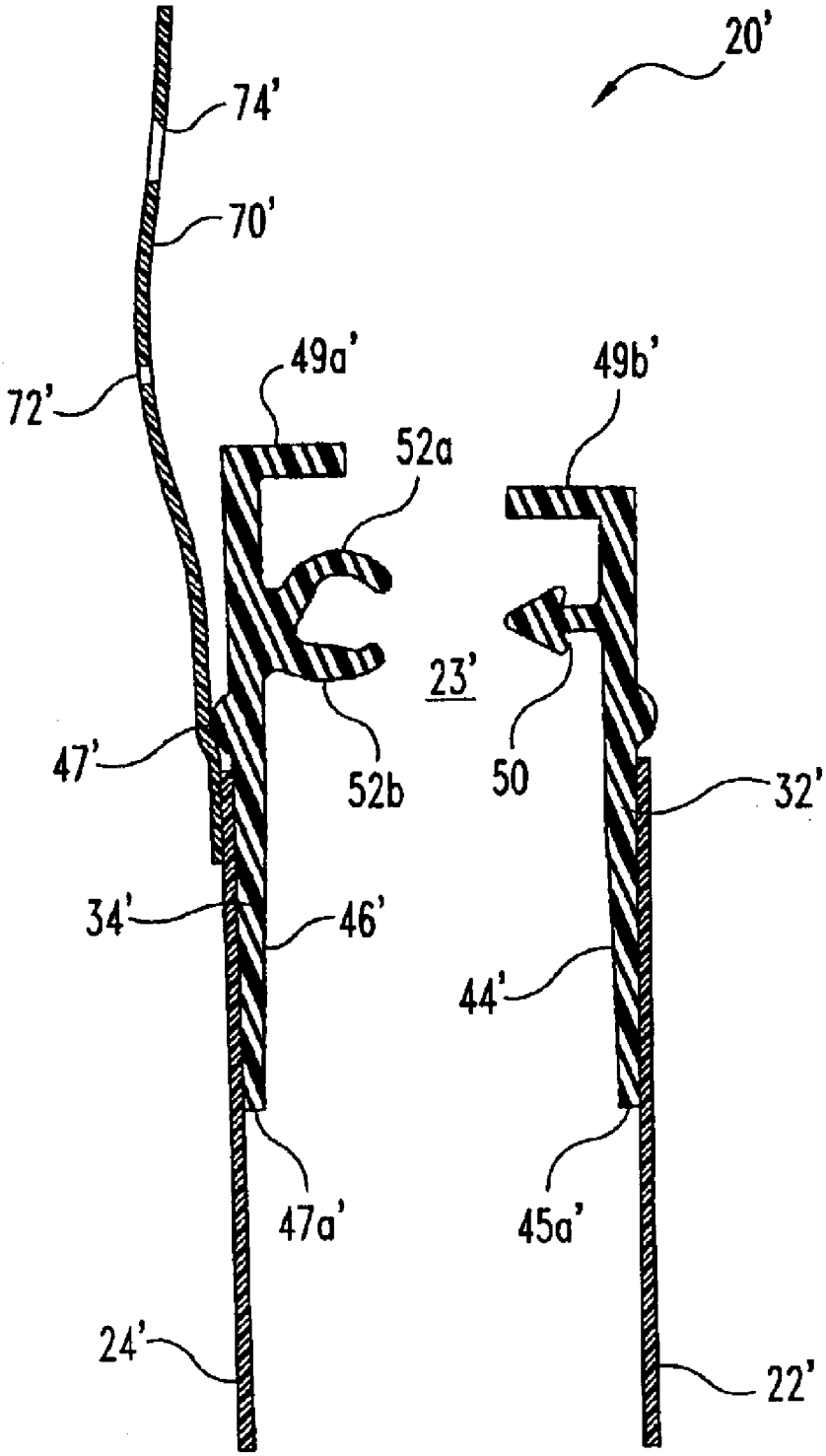
FIG. 3 is a cross-sectional view of a container according another embodiment of the present invention.

In some embodiments of the present invention profiles 50 and 52 are comprised of at least one uppermost and bottommost profile elements. Preferably, one profile element terminates in a shape that can be securely grasped by a complementary-shaped profile element coupled to the opposing side wall. Referring to FIGS. 2 and 3, apparatus 20 includes a male profile element 50 which interlocks between female profile elements 52*a* and 52*b* of fastener strip 34. These fastener strips and profile elements are further described in U.S. Provisional Patent Application No. 60/330,140, filed Oct. 17, 2001, entitled SLIDERS FOR RECLOSEABLE CONTAINERS, incorporated herein by reference. However, the present invention contemplates the use of any type of profile elements compatible with a slider. When fastener strips 32 and 34 are interlocked, cover flanges 49*a* and 49*b* are disposed in overlapping relationship and provide a secondary seal of container 20. Of course, the primary seal is provided by the coupling of fastener strips 32 and 34. As best seen in FIG. 1, a slider 48 straddles and is slidable upon fastener strips 32 and 34. Slider 48 includes a pair of feet (not shown) which retain slider 48 on the interlocking fastener strips by way of shoulders 45 and 47. Further, slider 48 includes a closing end (not shown) which includes a reduced-width aperture which presses the profile elements into interlocking relationship. Slider 48 further includes a separator (not shown) near an opening end which spreads apart and unlocks the profile elements. Movement of slider 48 along the fastener profiles results in either an interlocking of profile elements 50 and 52, or an unlocking of profiles 50 and 52. The present invention contemplates any configuration of slider which locks and unlocks the profile elements, including the sliders, endstops, profiles, docking stations, and other features of a reclosable container disclosed in U.S. patent application Ser. No. 09/794,592, filed Feb. 27, 2001, and incorporated herein by reference.

Some embodiments of the present invention further include a docking station 39 located near endstop 38 and or endstop 36. The docking station provides a location which accommodates the separator element of a slider, and relieves the forces from the separator which would otherwise tend to separate the fastener strips. As one example, the docking station may be formed by placement of the slider adjacent to a heat-fused endstop before the endstop cools. In yet other embodiments, the docking station may be one of a vertical slit, horizontal slit, notch, or window placed in the fastener strips near the corner seals. Additional examples of flexible reclosable containers contemplated by the present invention can be found in U.S. Provisional Patent Application No. 60/330,140, filed Oct. 17, 2001, entitled SLIDERS FOR RECLOSABLE CONTAINERS, incorporated herein by reference.

In one embodiment of the present invention, container 20 does not include a tamper evident seal. However, in some embodiments of the present invention, containers 20 and 120 include a tamper-evident seal 143 between side walls 22 and 24. This seal may be an extension of flanges 46 and 44 that extends internally across the opening of container 20. However, the present invention contemplates other configurations of tamper evident seal, including external seals that cover portions of the fastener profiles and slider. The seal may be integrally molded with flanges 44 and 46, or may be attached separately. Further, the seal may be integrally molded with side walls 22 and 24 or attached separately. The broken or unbroken state of the seal provides evidence to the user of whether or not the container has been previously opened. A tamper evident seal is especially useful with a form, fill, and seal machine that inserts an edible product into container 20. Further examples of tamper evident seals can be found in U.S. Pat. No. 6,257,763, issued Jul. 10, 2001, and incorporated herein by reference. Yet other forms of laser-scored tamper evident elements are contemplated by the present invention and can be found in U.S. Provisional Patent Application No. 60/314,787, filed Aug. 24, 2001, entitled SCORED TAMPER EVIDENT ZIPPER SLIDER, and incorporated herein by reference.

FIG. 2 is a close-up cross-sectional view according to one embodiment of the present invention. A header strip 70 extends outwardly from one side of mouth 23. One or more apertures or holes 74 are defined in the upper portion of header 70. Header strip 70 is preferably an integral portion of container side 24, and in one embodiment extends about three inches beyond the end of shorter container side 22. Container side 24 is preferably fused to flange 46 of fastener strip 34 at a location intermediate of fastener strip shoulder 47 and fastener strip bottom edge 47*a*. By locating the attachment below the shoulder 47, the attachment feet (not shown) of slider 48 are free to move over shoulder 47 without interference by the container side wall or header strip.

Preferably, a tear line or line of weakness 72 is created along the length of header strip 70 in a direction generally parallel to the edge of mouth 23. This line of weakness can be located along header strip 70 anywhere from hole 74 of header strip 70, to the location where container sidewall 24 is fused to fastener strip 34. The line of weakness 72 can be implemented in any manner, including mechanical scoring or perforation, laser scoring, or any other method.

FIG. 3 depicts a cross-sectional view of another embodiment according to the present invention. The use of a prime (') suffix with an element number (XX') denotes an element that is the same as the element previously cited (XX), except for those changes shown or described hereafter. Header strip 70' is separately attached to profile element 34'. Header strip 70' includes one or more apertures or holes 74'. Header strip 70' preferably includes a line of weakness 72' along the length of header strip 70' in a direction generally parallel of the edge of mouth 23'. Header strip 70' is preferably attached by fusion or adhesion at a location below shoulder 47' so as to not interfere with sliding operation of slider 48. Further, the present invention also contemplates those embodiments in which the header strip is integrally extruded with the fastener strip.

Figure 4:
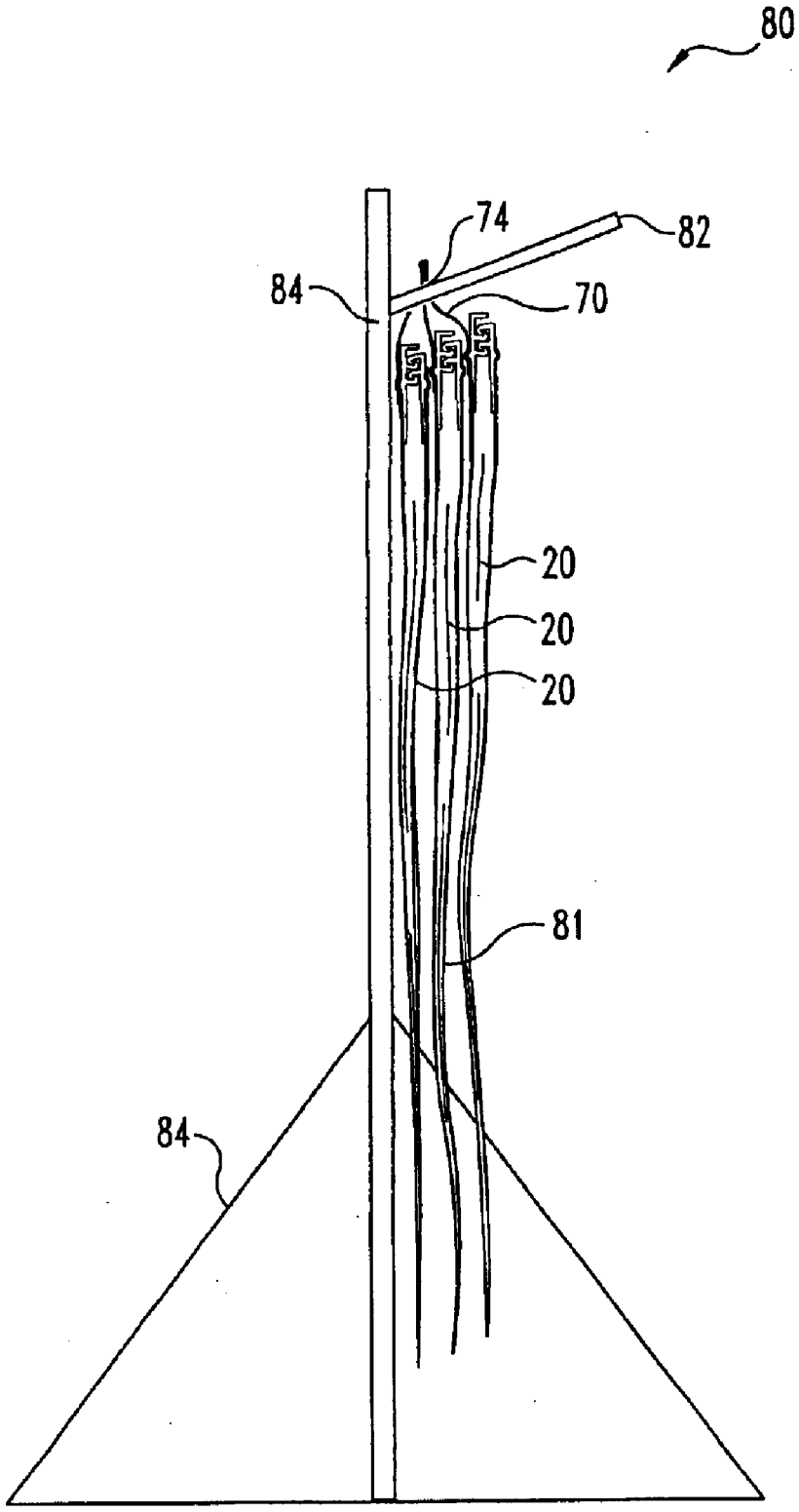
FIG. 4 is a side view of another embodiment of the present invention.

FIG. 4 is a side view of an apparatus 80 according to another embodiment of the present invention. Apparatus 80 includes a plurality of containers 20 which have been attached together into a group 81 by fusing together adjacent portions of the corresponding header strips 70. The header strips are fused or adhered together such that adjacent through holes 74 line up in a manner suitable for mounting container group 81 from a wicket 82. Wicket 82 is preferably supported by a stand 84 such that containers 20 extend downward vertically from wicket 82. Stand 84 is preferably located near the products to be stored in the containers. In yet other embodiments of the present invention, apparatus 80 includes a plurality of containers 20 which have not been attached together into a group, and which instead hang individually from wicket 82.

Figure 5:
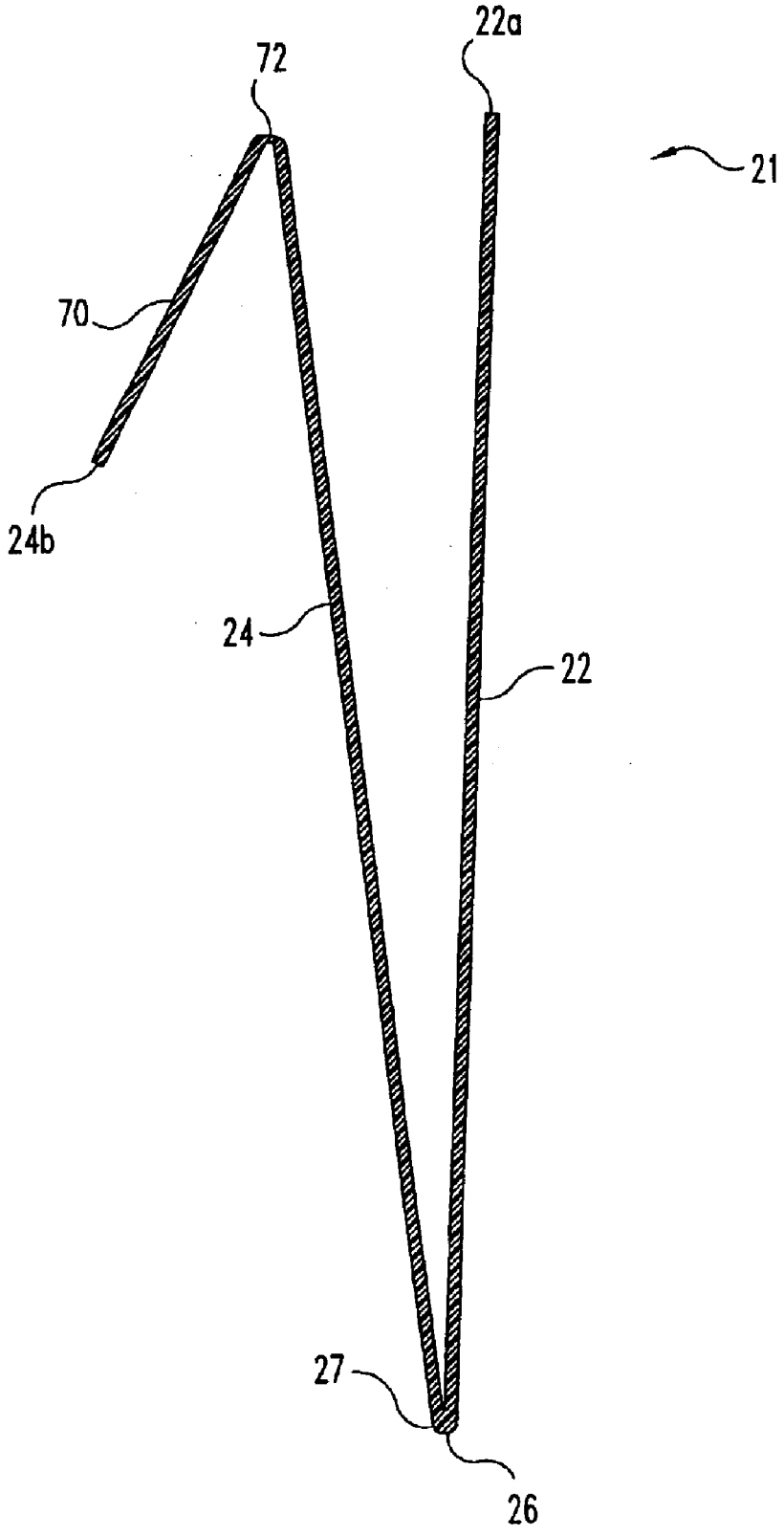
FIG. 5 is side view of a partially constructed container according to another embodiment of the present invention.

FIG. 5 is a side view of a partially constructed container 21 according to another embodiment of the present invention. In this embodiment of the present invention, a sheet is fabricated starting with blown low density polyethylene (LDPE) material, or other material suitable for fabrication of flexible reclosable container. Using a bag machine such as an Amplas MS 1400 Servo machine, the film sheet 21 is folded to include a center fold 27, with one side 24 being about three inches longer than shorter side 22. Line of weakness 72 is created in second side 24 in a manner as previously discussed. Preferably, line of weakness 72 is located approximately opposite free edge 22*a* of shorter side 22. In this embodiment, the length from bottom fold 27 to line of weakness 72 is about the same as the length from bottom fold 27 to free edge 22*a* of shorter side 22. However, the present invention also contemplates those embodiments in which these lengths differ significantly.

After installing line of weakness 72, a folding device folds back a portion 70. This configuration of sheet 21 then enters a fastener attachment machine where a fastener strip is attached along free edge 22*a,* and a second fastener strip is applied proximate to line of weakness 72. Following application of the fastener to sheet 21, slider endstops 40 and 42 are formed, sealed side edges 28 and 30 are formed, and slider 48 is attached to the interlockable fastener strips. However, the present invention can be fabricated using a different sequence of processing. For example, line of weakness 72 can be incorporated after attachment of the fastener strips. Further, slider 48 can be attached to the fastener strips prior to their attachment to sheet 21.

Preferably following attachment of the slider and fastener strips, the folded portion 70 of sheet 21 is folded back out to facilitate the punching of one or more holes 74. In some embodiments, multiple containers 20 are attached together by fusing together adjacent portions of header strips 70. The plurality 81 of fused together containers 20 can then be hung from a wicket 82. Preferably, each slider of a container is placed in a position such that the mouth of the container is substantially open. By having the mouth open, it is convenient for a user to place his or her fingers within the container, tear the container from the wicket along the tear line, and since the container is substantially open, readily place an object in the container.

Figure 6:
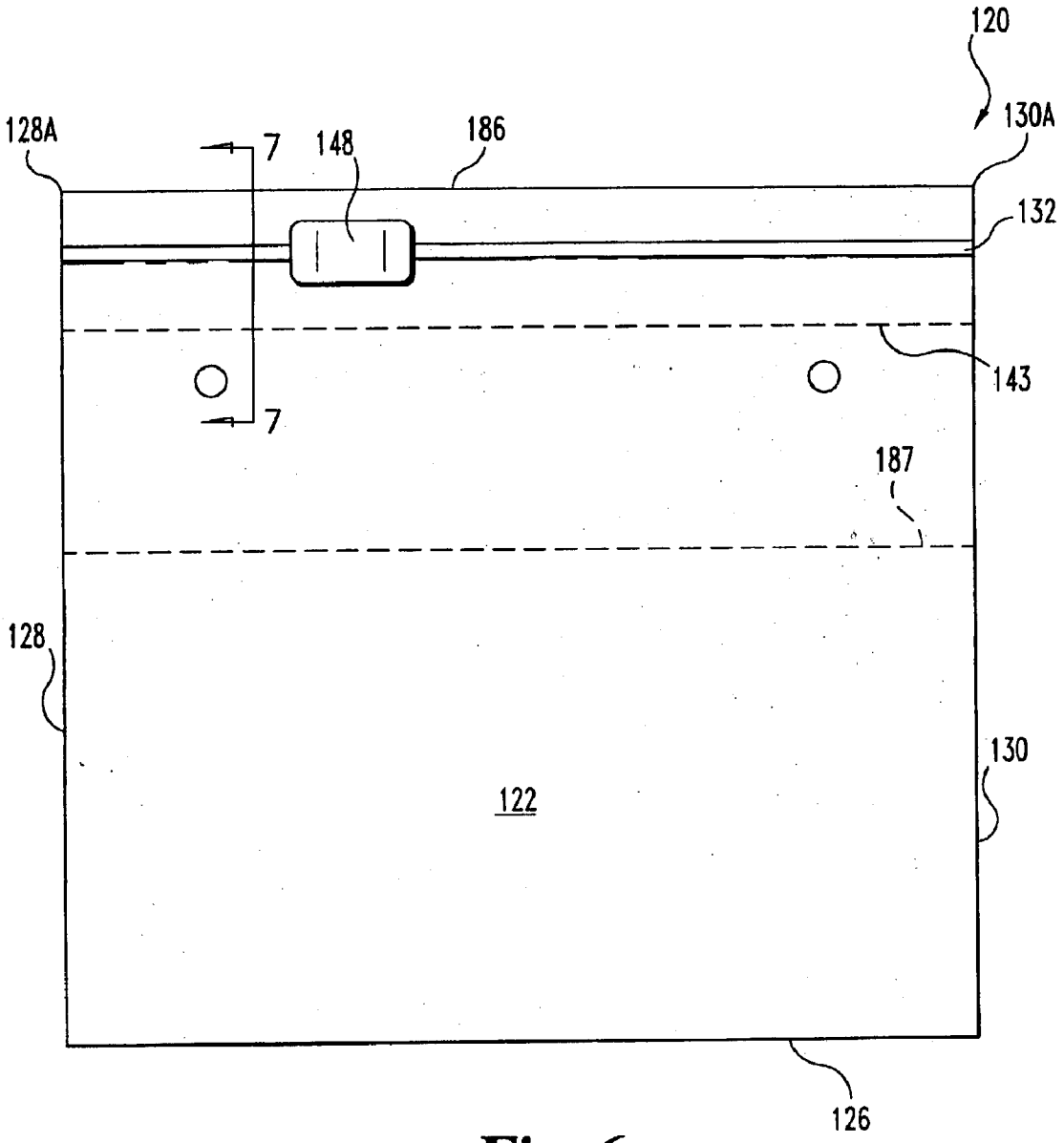
FIG. 6 is a plan side view of a container according to another embodiment of the present invention.
Figure 7:
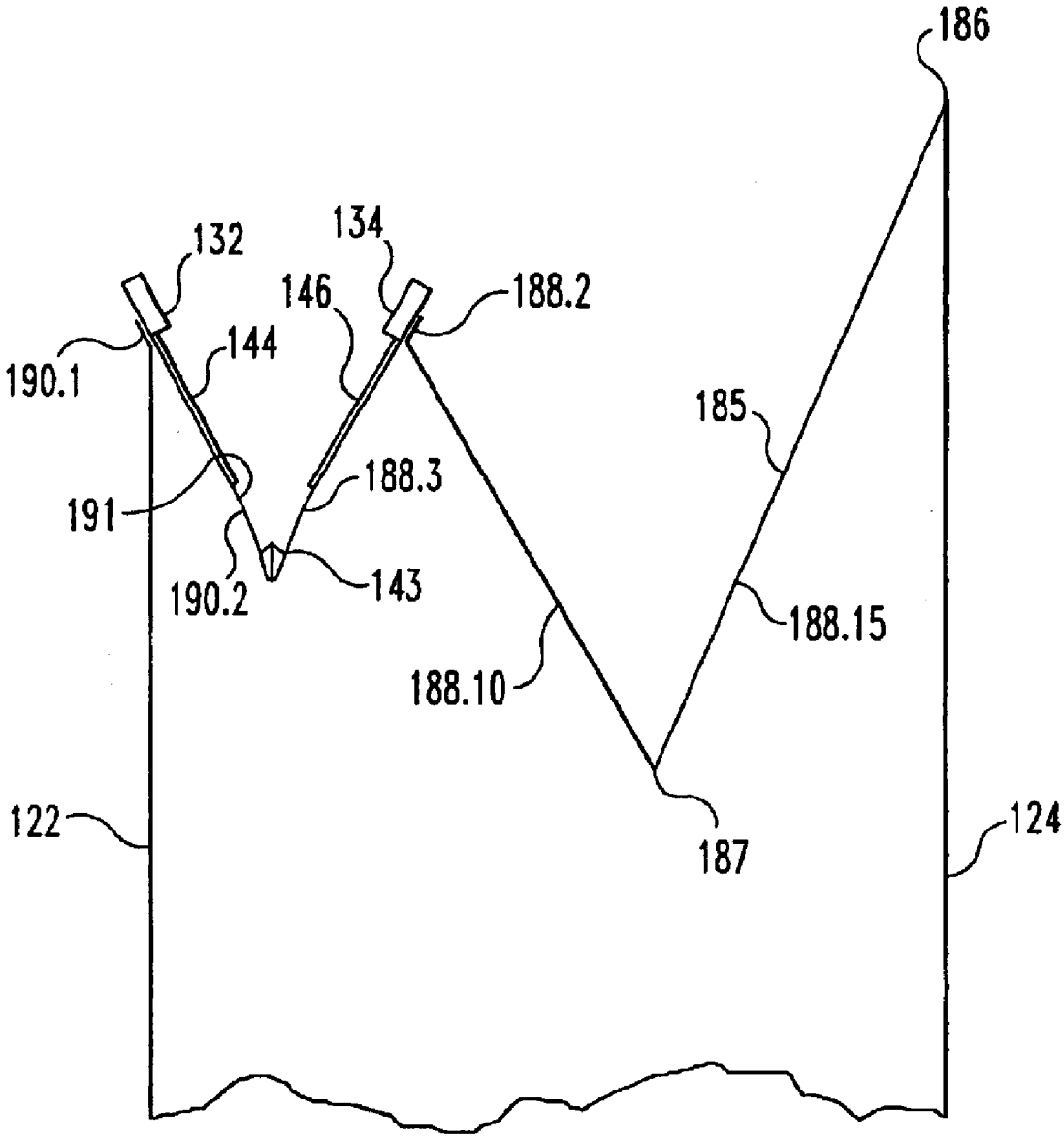
FIG. 7 is a side elevational view of a portion of the container of FIG. 6 as taken along line 7—7 of FIG. 6, and in an expanded state.
Figure 8:
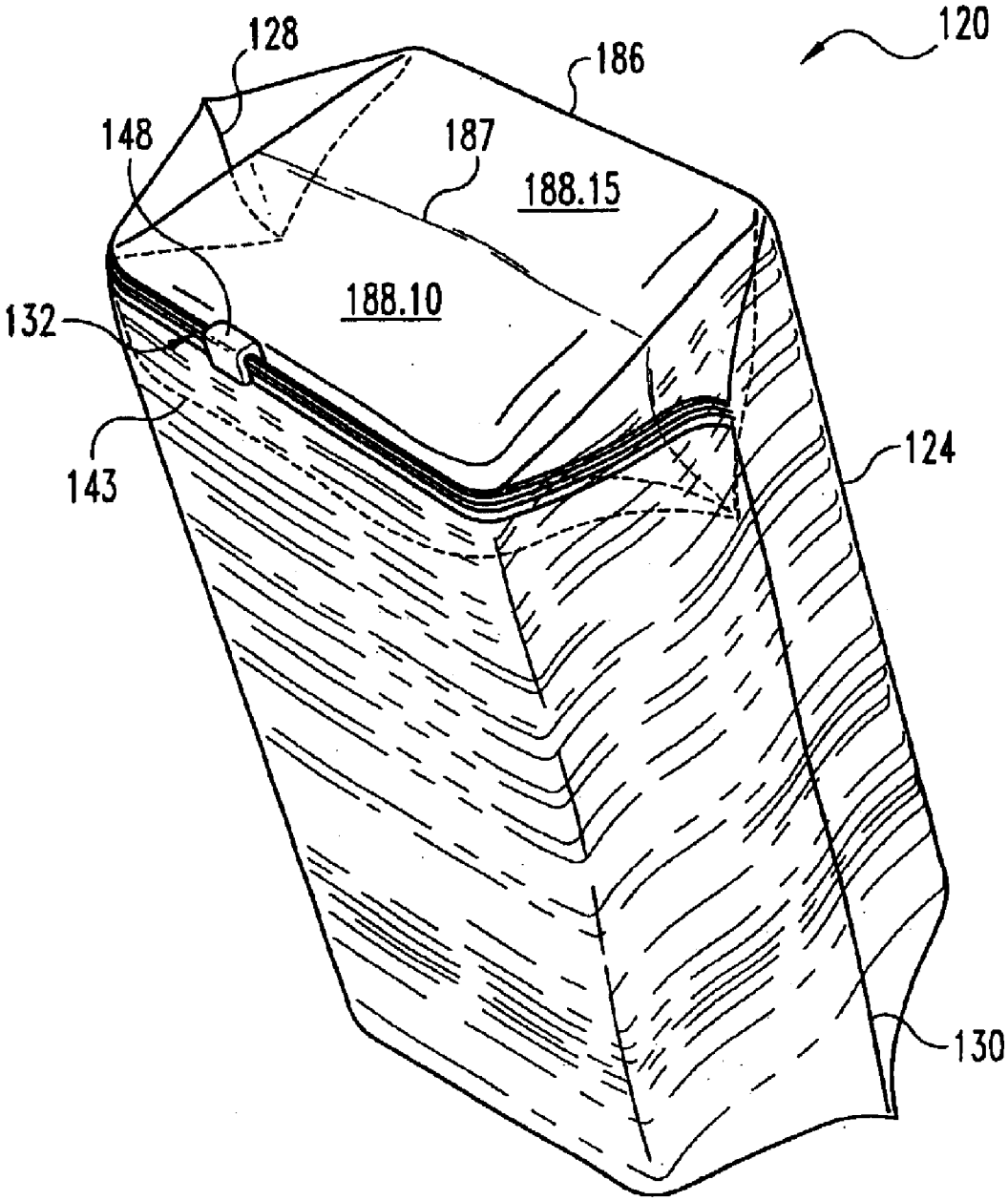
FIG. 8 is a top perspective view of the container of FIG. 6 filled with a product.

FIGS. 6, 7 and 8 depict various views of a gusseted bag according to another embodiment of the present invention. The use of a one hundred series prefix with an element number (1XX) denotes an element that is the same as the previously cited element (XX) except for those changes shown or described herein. This application incorporates by reference the following applications and issued patents, all owned by the same assignee: METHOD AND APPARATUS FOR PLACING A PRODUCT IN A FLEXIBLE RECLOSEABLE CONTAINER, Ser. No. 09/794,592, filed Feb. 27, 2001; TAMPER EVIDENT ZIPPER SLIDER, Ser. No. 09/866,457, filed May 25, 2001; SCORED TAMPER EVIDENT ZIPPER SLIDER, Ser. No. 60/314,787, filed Aug. 24, 2001; SLIDERS FOR RECLOSABLE CONTAINERS, Ser. No. 60/330,140, filed Oct. 17, 2001; METHOD AND APPARATUS FOR PLACING A PRODUCT IN A FLEXIBLE RECLOSABLE CONTAINER, Ser. No. 10/022,451, filed Dec. 17, 2001; and EXTENDED LIP WICKET SLIDER DELI BAG, Ser. No. 10/107,694 filed Mar. 27, 2002.

FIG. 8 shows a flexible reclosable container 120 incorporating a pair of top gussets. These gussets are best viewed in FIG. 7, which is an expanded view of a container of FIG. 6 as taken along line 7—7 of FIG. 6 in the direction of the arrows.

In one embodiment according to the present invention, container 120 includes a first top gusset 185 and a second top gusset 191. In one embodiment, first top gusset 185 is deeper, and therefore more expandable, than second top gusset 191. However, the present invention also contemplates those embodiments in which both gussets are of a similar depth and capable of similar expansion.

Referring to FIG. 7, first top gusset 185 is connected to side wall 124 from topmost fold 186 to bottommost fold 187, and further extends toward a third fold 188.2. Third fold 188.2 is preferably fusion bonded to one side of fastener strip 134. The fastener strip 134 is part of a reclosable closure which also includes fastener strip 132. First top gusset 185 includes a first gusset wall 188.15 extending between folds 186 and 187, and a second gusset wall 188.10 extending from fold 187 to fold 188.2.

Second top gusset 191 is connected to side wall 122 and extends from a first fold 190.1 to tamper evident seal 143. First fold 190.1 is fusion bonded to a side of fastener strip 132. A gusset wall 190.2 may be an extension of side wall 122 extending from first fold 190.1 along flange 144 to tamper evident seal 143. The opposing gusset wall 188.3 of second top gusset 191 extends from fold 188.2 and along a side of flange 146 toward tamper evident seal 143.

In some embodiments of the present invention, tamper evident seal 143 is a peelable seal, such that surfaces of gusset walls 188.3 and 190.2 are coated or co-extruded with materials sufficient to adhere together facing surfaces of gusset walls 188.3 and 190.2.

In other embodiments of the present invention, gusset walls 109.2 and 188.3 are joined together in a fusion seal to form tamper evident seal 143. In these embodiments, tamper evident seal 143 can include a laser scored or mechanically scored line of weakness. In yet other embodiments of the present invention, second top gusset 191 includes first and second gusset walls 190.2 and 188.3 that are integral, such that the top portion of container 120 is continuous through fold 190.1, tamper evident seal 143, fold 188.2, fold 187, and fold 186.

The present invention lends itself to other methods of construction. For example, as has been described, the topmost free edges of the plastic film from which container 120 is fabricated are joined together at tamper evident seal 143 in a peel seal. Further, a method of fabrication has been described in which the free edges of the web of plastic film are along the bottom of container 120, such that the pair of top gussets are continuous. However, it is to be appreciated that the present invention contemplates still other methods of fabrication, in which the free edges of the web of plastic film are joined together and joined to fastener strip 132 in place of fold 190.1. In yet other embodiments, the free edges of the plastic film are joined together and joined to fastener strip 134 at a location replacing fold 188.2. In yet other embodiments, the free edges are joined together replacing fold 187. In yet other embodiments, the free edges are joined together replacing fold 186.

FIG. 8 shows container 120 containing product such as napkins. In one embodiment, these napkins are loaded from the bottom of container 120, by either splitting bottom edge 126, or separating the free edges during filling in those embodiments in which the free edges of the web of plastic film are provided at the bottom of the container.

As best seen in FIG. 8, the top gussets of the present invention permit container 120 to be filled with a bulky item, yet also permit container 120 to be substantially flat when not filled. When filled with a bulky product, the top of container 120 expands. Bottom fold 187 moves to a location along the top of container 120. Gusset walls 188.10 and 188.15 extend across the top of container 120. As shown in FIG. 8, the gusset 185 extends across and closes off the mouth of the bag when the fastener strips are connected to one another. Further, the slider 148 and the fastener strips 132 and 134 are squared off and out of the way along the side of the container 120.

The side walls 122 and 124 are sealed or fused together at 128 in similar fashion to the above described embodiment of FIGS. 1–5. It should also be noted that in the embodiment of FIG. 8 the side walls 122 and 124 are also sealed or fused to the gussets with the fusion or attachment extending to the corners 128A and 130A of the container as viewed in FIG. 6.

As shown in FIG. 8, fastener strips 132 and 134 extend half way around container 120, and preferably around the top edge of the filled container. Second gusset 191 remains unexpanded when the profiles of the fastener strips are interlocked. In order to open container 120, the consumer moves slider 148 in an unlocking direction, such that fastener strips 132 and 134 are released from one another. The user can then pull apart gusset walls 190.2 and 188.3, and thereby separate tamper evident seal 143. The user can then reach into container 120, remove the product, and then reseal the fastener strips by moving slider 148 in an interlocking direction.

Figure 9:
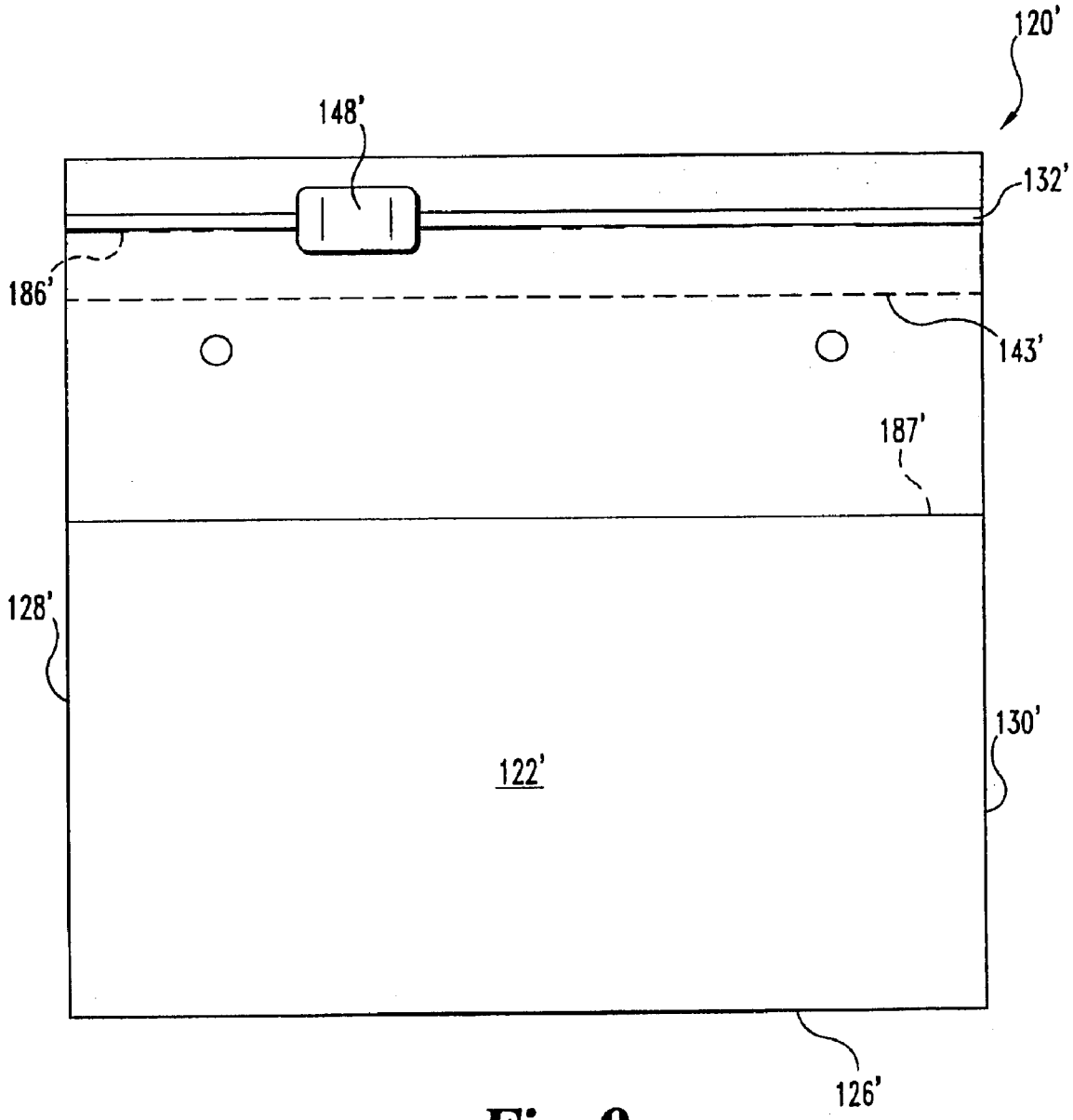
FIG. 9 is a plan side view of a container according to another embodiment of the present invention.

Referring to FIG. 9, another embodiment of the present invention is shown and described. Container 120' is the same as the various embodiments of container 120 previously described, except that top fold 186' is lower than top fold 188.2.

The type of reclosable features discussed as shown in FIGS. 6, 7, 8, and 9 allow products to be presented on a shelf with the bags squared out and opened. As an example, a stack of paper napkins of a square folded shape can be displayed on a grocer's or homeowner's shelf with the reclosable closure squared off and out of the way. As another example of the use of the invention, it can be used to package bread. The bread is easily visible through the clear plastic film of the container. Also the container can be easily resealed by the reclosable closure operated by the slider keeping the bread fresh. In some embodiments the fastener profiles are sealed to the outside to the plastic film so that the integrity of the package is not interfered with by the addition of fastener profiles and a slider. The tamper evident feature is achieved in some embodiments of the present invention by sealing the fastener profiles onto the outside of the second gusset.

In some embodiments of the present invention, bottom 126 includes an internal gusset (not shown). In other embodiments, bottom 126 is a fold of the web of plastic film. In yet other embodiments, bottom 126 comprises free edges of side walls 122 and 124 that are fused together.

Referring to FIG. 6, preferably sides 128 and 130 are fused together from top fold 186 to bottom edge 126, referring to FIG. 6. In these embodiments, the side edges of first gusset 185 and second gusset 191 are fused together, and fused to the edges of side walls 122 and 124. In yet other embodiments, the side edges of the first and second gussets are not fused to the edges of side walls 122 and 124.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed:

1. A plastic film bag comprising (a) a pair of side walls which are secured to one another and define a mouth of the bag;

(b) a first gusset and a second gusset joined to one another and extending across the mouth of the bag;

(c) said second gusset including a tamper evident seal;

(d) and fastener strips mounted on said bag for closing off access to the interior of the bag through said tamper evident seal, said fastener strips allowing access when they are disconnected from one another and preventing access when they are connected to one another, said fastener strips being mounted on said second gusset and adapted to close off access to the interior through the second gusset;

(e) said first gusset being adapted to extend across and close off the mouth of the bag when the fastener strips are connected to one another; and (f) said first gusset including a connection at one of said side walls, said connection being located above said mouth when said first gusset is folded.

2. The plastic film bag of claim 1 additionally comprising a slider slidably mounted on said strips for connecting and disconnecting said fastener strips.

3. The plastic film bag of claim 2 wherein said first gusset is deeper than said second gusset.

4. The plastic film bag of claim 2 wherein said tamper evident seal is the second gusset itself.

5. The plastic film bag of claim 2 wherein said tamper evident seal is a peelable seal.

6. The plastic film bag of claim 2 wherein said gussets have side edges which are fused together.

7. The plastic film bag of claim 1 further comprising a header strip extending outwardly from said mouth.

8. A plastic film bag comprising (a) a first side wall and a second side wall which are secured to one another and define a mouth of the bag;

(b) a first gusset and a second gusset joined to one another and extending across the mouth of the bag, said first gusset being connected to said second sidewall by a first connection, said first gusset being connected to said second gusset by a second connection, said second gusset being connected to said first side wall by a third connection;

(c) said second gusset including a tamper evident seal that is spaced from said second connection and said third connection;

(d) and fastener strips mounted on said bag for closing off access to the interior of the bag through said tamper evident seal, said fastener strips being mounted on said second connection and said third connection, said fastener strips allowing access when they are disconnected from one another and preventing access when they are connected to one another;

(e) said first gusset being adapted to extend across and close off the mouth of the bag when the fastener strips are connected to one another; and (f) said first connection being located above said mouth when said first gusset is folded.

9. The plastic film bag of claim 8 additionally comprising a slider slidably mounted on said strips for connecting and disconnecting said fastener strips.

10. The plastic film bag of claim 8 wherein said tamper evident seal is a peelable seal.

11. The plastic film bag of claim 8 further comprising a header strip extending outwardly from said mouth.

12. A plastic film bag comprising (a) a pair of side walls which are secured to one another and define a mouth of the bag;

(b) a first gusset and a second gusset joined to one another and extending across the mouth of the bag, said first gusset being deeper than said second gusset and including a connection at one of said side walls, said connection being located above said mouth when said first gusset is folded;

(c) said second gusset including a tamper evident seal;

(d) fastener strips mounted on said bag for closing off access to the interior of the bag through said tamper evident seal, said fastener strips allowing access when they are disconnected from one another and preventing access when they are connected to one another;

(e) said first gusset being adapted to extend across and close off the mouth of the bag when the fastener strips are connected to one another;

(f) and a slider slidably mounted on said strips for connecting and disconnecting said fastener strips.

13. The plastic film bag of claim 12 wherein said tamper evident seal is the second gusset itself.

14. The plastic film bag of claim 12 wherein said tamper evident seal is a peelable seal.

15. The plastic film bag of claim 12 wherein said gussets have side edges which are fused together.

16. The plastic film bag of claim 12 further comprising a header strip extending outwardly from said mouth.

* * * * *